US010550737B2

(12) United States Patent
Harmon, Sr.

(10) Patent No.: US 10,550,737 B2
(45) **Date of Patent: *Feb. 4, 2020**

(54) HIGH EFFICIENCY STEAM ENGINE HAVING IMPROVED STEAM CUTOFF CONTROL

(71) Applicant: Thermal Power Recovery LLC, Mahtomedi, MN (US)

(72) Inventor: James V. Harmon, Sr., Mahtomedi, MN (US)

(73) Assignee: Thermal Power Recovery LLC, Mahtomedi, MN (US)

( * ) Notice: Subject to any disclaimer, the term of this patent is extended or adjusted under 35 U.S.C. 154(b) by 14 days.

This patent is subject to a terminal disclaimer.

(21) Appl. No.: 15/914,417

(22) Filed: Mar. 7, 2018

(65) Prior Publication Data

US 2018/0223703 A1 Aug. 9, 2018

Related U.S. Application Data

(63) Continuation-in-part of application No. 15/794,486, filed on Oct. 26, 2017, now Pat. No. 10,273,840, (Continued)

(51) Int. Cl.
*F01L 9/04* (2006.01)
*F01B 9/02* (2006.01)
(Continued)

(52) U.S. Cl.
CPC ..... *F01L 9/04* (2013.01); *F01B 9/02* (2013.01); *F01B 17/04* (2013.01); *F01B 31/26* (2013.01);
(Continued)

(58) Field of Classification Search
CPC ..... F01L 9/04; F01L 23/00; F01L 2009/0478; F01L 2009/0403; F01L 2009/0405;
(Continued)

(56) References Cited

U.S. PATENT DOCUMENTS 1,090,417 A 3/1914 Schmidt
1,167,527 A 1/1916 Schmidt
(Continued)

FOREIGN PATENT DOCUMENTS

CN 109026254 A * 12/2018 ..... F01L 9/04
DE 102013105670 A1 * 12/2014 ..... F01L 9/04
(Continued)

OTHER PUBLICATIONS http://www.kimmelstream.com/gelbart-uniflow.html, Dan Gelbart's Advanced Uniflow Steam Engine, Copyright © 2012, three pages.

*Primary Examiner* — Thai Ba Trieu
(74) *Attorney, Agent, or Firm* — Thomas J. Nikolai; DeWitt LLP

(57) ABSTRACT

A high efficiency uniflow steam engine with automatic inlet and exhaust valves rather than camshaft operated valves includes an electromagnet and cooperating armature that actuates a cutoff control valve for closing a steam inlet valve at any time selected to stop the flow of steam to the cylinder. Approaching the end of the exhaust stroke typically 0.12 inch before TDC the cylinder is sealed thereby compressing the remaining residual steam down to a minute clearance approaching zero, for example, 0.020 inch to raise cylinder steam pressure enough to open the steam inlet valve without physical contact between the piston and the steam inlet valve thereby eliminating tappet noise, shock and wear.

14 Claims, 6 Drawing Sheets

Related U.S. Application Data which is a continuation-in-part of application No. 15/077,576, filed on Mar. 22, 2016, now Pat. No. 9,828,886, which is a continuation-in-part of application No. 13/532,853, filed on Jun. 26, 2012, now Pat. No. 9,316,130, which is a continuation-in-part of application No. 12/959,025, filed on Dec. 2, 2010, now Pat. No. 8,448,440.

(51) Int. Cl.
*F01B 17/04* (2006.01)
*F01B 31/26* (2006.01)

(52) U.S. Cl.
CPC ... *F01B 2250/001* (2013.01); *F01B 2250/002* (2013.01); *F01L 2009/0478* (2013.01)

(58) Field of Classification Search
CPC ..... F01L 2009/0407; F01L 2009/0409; F01L 2009/0423; F01L 2009/0428; F01B 17/04; F01B 31/26; F01B 2250/001; F01B 2250/002
USPC ..... 60/670; 123/90.11, 90.12; 91/50, 410
See application file for complete search history.

(56) References Cited

U.S. PATENT DOCUMENTS

| | | | | |
|---|---|---|---|---|
| 1,514,504 | A | 11/1924 | Cohen | |
| 2,295,962 | A | 9/1942 | Mueller | |
| 2,402,699 | A | 6/1946 | Williams | |
| 2,943,608 | A | 7/1960 | Williams | |
| 3,279,326 | A | 10/1966 | Harvey et al. | |
| 3,397,619 | A | 8/1968 | Sturtevant | |
| 4,008,574 | A * | 2/1977 | Rein | F02G 1/02 60/516 |
| 4,050,357 | A * | 9/1977 | Carter, Sr. | F01L 23/00 91/410 |
| 4,166,410 | A * | 9/1979 | Schlosser | F01L 23/00 91/50 |
| 5,103,779 | A * | 4/1992 | Hare, Sr. | F01L 9/04 123/182.1 |
| 5,193,495 | A * | 3/1993 | Wood, III | F01L 9/02 123/90.12 |
| 7,225,771 | B2 * | 6/2007 | Hedman | F01L 9/04 123/90.12 |
| 7,367,785 | B2 | 5/2008 | Roberts | |
| 7,603,858 | B2 * | 10/2009 | Bennett | F01L 1/46 60/517 |
| 8,448,440 | B2 | 5/2013 | Peoples et al. | |
| 8,661,817 | B2 | 3/2014 | Harmon, Sr. et al. | |
| 9,316,130 | B1 | 4/2016 | Harmon, Sr. et al. | |
| 9,657,568 | B2 | 5/2017 | Bielenberg | |
| 9,784,147 | B1 | 10/2017 | Harmon, Sr. | |
| 9,828,886 | B1 | 11/2017 | Harmon | |
| 10,100,687 | B2 * | 10/2018 | Glaser | F01L 9/04 |

FOREIGN PATENT DOCUMENTS

| | | | | |
|---|---|---|---|---|
| DE | 102015104799 | A1 * | 9/2016 | F01L 9/04 |
| FR | 3001762 | A1 * | 8/2014 | F01L 9/04 |
| JP | 359099016 | A | 6/1984 | |

* cited by examiner

FIG. 2

STEAM CONSUMPTION RATE OF THE INVENTION AND HIGH COMPRESSION ENGINE*

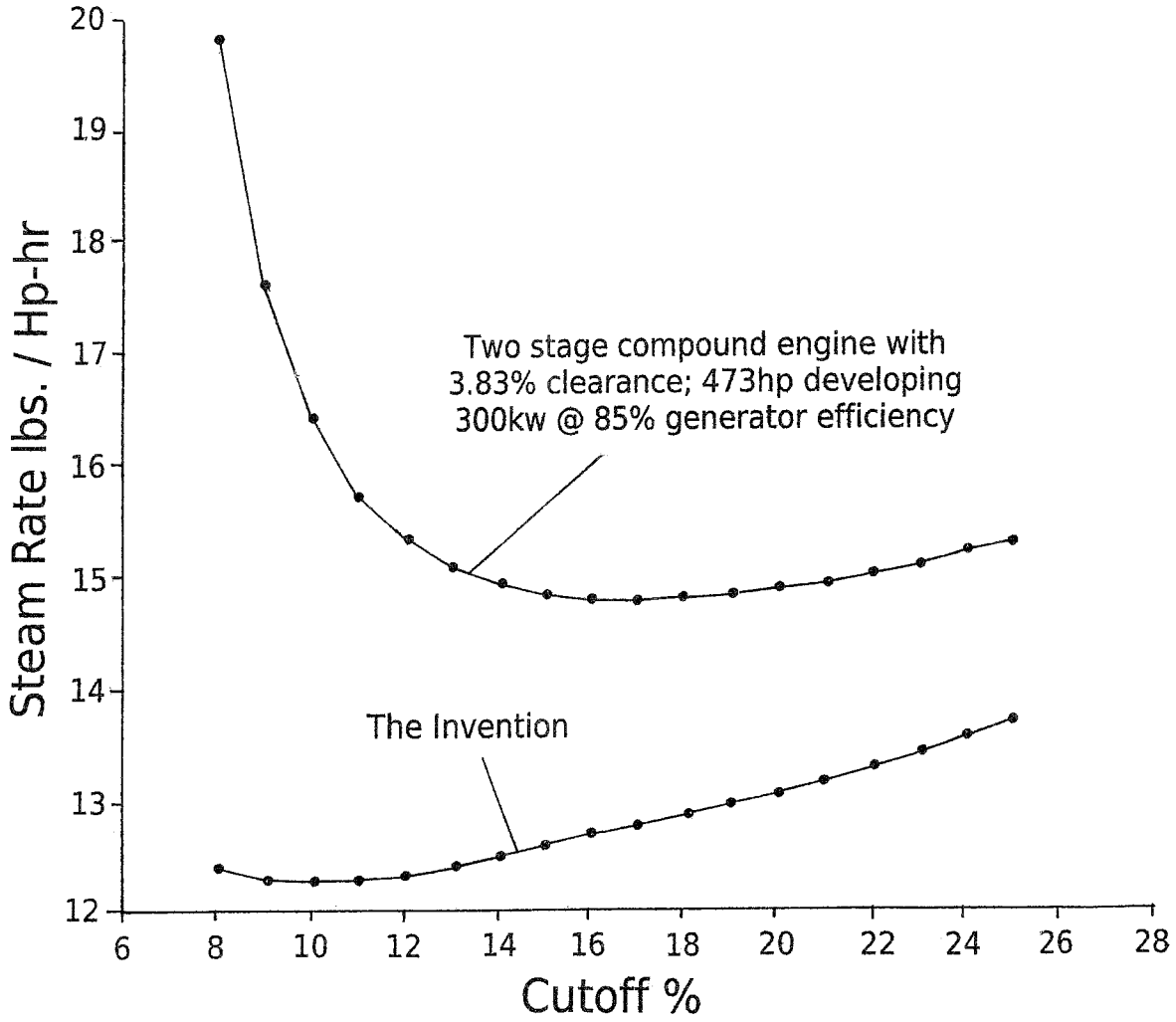

CONDITIONS:

| | | | |
|---|---|---|---|
| SUPPLY STREAM TEMRERATURE, R | = | 960.0 | 260°C |
| THROTTLE PRESSURE, psia | = | 363.0 | 25 Bar |
| COMPRESSION PRESSURE, psia (HCU) | = | 363.5 | 25 Bar |
| ENTHALPY CHANGE THROUGH GENERATOR | = | 1150.0 | Btu/lb. |
| CONDENSER SUCTION PRESSURE, psia | = | 7.25 | .5 Bar |
| COMPRESSIBILITY @ TS | = | 0.918 | |

*Assume 70% pump efficiency; Friction Assume $\frac{\text{.5ft-lb Torque}}{\text{In.}^3\text{ displacement}}$

HIGH EFFICIENCY STEAM ENGINE HAVING IMPROVED STEAM CUTOFF CONTROL

I. CROSS REFERENCE TO RELATED APPLICATIONS

The present application is a continuation-in-part of pending application Ser. No. 15/794,486 filed Oct. 26, 2017, which is a continuation-in-part of application Ser. No. 15/077,576 filed Mar. 22, 2016, now U.S. Pat. No. 9,828,886, which is a continuation-in-part of application Ser. No. 13/532,853 filed Jun. 26, 2012, now U.S. Pat. No. 9,316,130, which is in turn a continuation-in-part of Ser. No. 12/959,025, filed Dec. 2, 2010, now U.S. Pat. No. 8,448,440 all of which are incorporated herein by reference.

II. FIELD OF THE INVENTION

This invention relates to high efficiency steam engines and to improved valve mechanisms and operating methods for such engines.

III. BACKGROUND OF THE INVENTION

Much of the epic progress during the industrial revolution in the United States during the $19^{th}$ and $20^{th}$ century was powered by steam. However, the thermal efficiency of steam powered piston engines could not match that of the Otto or Diesel engines developed at the end of the $19^{th}$ century. A substantial improvement in steam engine efficiency was however made when the uniflow steam engine was developed by Professor Stumpf in Germany and improved further in the U.S. by C. C. Williams high compression uniflow engine based on compression as described in U.S. Pat. Nos. 2,402,699 and 2,943,608 in which steam is compressed to boiler pressure by the piston return stroke thereby raising the steam temperature for example 95 to 342 degrees hotter than feed steam in a sizeable clearance volume that may be 7% to 14.5% of displacement. The thermal efficiency of even these engines while improved, could not however reach that of the internal combustion engine.

Recently, a substantial further advance has been made through the development of steam engines operating on a cycle that employs essentially zero clearance between the piston and the cylinder head at the end of the exhaust stroke while at the same time any steam in the cylinder is under little or no compression. This arrangement achieves a remarkable increase in thermal efficiency as disclosed in U.S. Pat. Nos. 8,448,440, 9,316,130, 8,661,817, 9,828,886 and U.S. patent application Ser. No. 15/794,486 filed Oct. 26, 2017, now U.S. Pat. No. 10,273,840 which are assigned to the Applicant's assignee and incorporated herein by reference. Engines in which both piston clearance and compression approach zero (the Z-Z operating principle) described in the latter five patents noted provide a thermal efficiency which ranges from an improvement of about 15% to an extraordinary 59% better than the best performing high compression uniflow engines that are widely recognized to have the highest thermal efficiency of any steam engine (see FIG. 1). The outstanding efficiency of the engines built according to the Z-Z patents listed above results from several factors including the Z-Z operating principle and benefits arising from the use of a unique, fast acting inlet valve which can open fully in some embodiments in less than 1 millisecond thereby avoiding losses formerly caused by a restriction in the flow of steam through the steam inlet valve while the valve is being opened by a cam or eccentric which may take as much as ⅓ to ½ of a crankshaft rotation resulting in reduced power output. By contrast, since the inlet valve of Z-Z engines of the present invention is opened fully almost instantly while the piston clearance is virtually zero, work output begins at the highest steam supply pressure earlier in the cycle thereby providing more power while also eliminating losses associated with having to compress to supply pressure a substantial quantity of steam that remains in the cylinder. One aim of the present invention is to be able to achieve these advantages disclosed in the Z-Z patents listed above while also timing the admission of steam into the cylinder electrically, e.g., by means of an electric engine control unit (ECU) over a wide range of cutoff settings without adversely affecting the advanced thermal efficiency of Z-Z engine principles.

In the Z-Z engine patents noted above and in other engines that use an electrically controlled steam cutoff, the magnetic field of an electromagnet typically acts on the valve itself. The valve must therefore be massive and formed from iron which can make operation at speeds over 5000 RPM difficult or impossible. Another obstacle is the delay caused by the time taken for the magnetic field of an electromagnet to build and then collapse resulting from the induction of a counter EMF which may take as long as 7-10 milliseconds or more. This limits the speed at which the engine can run especially if more than one valve function must be timed.

A more specific purpose of the present invention to retain the high efficiency and other advantages of the Z-Z engine patents noted above while actuating one or more valves by piston movement with little or no valve wear while opening or closing the valve in under 1 millisecond. By achieving these objectives in accordance with the present invention, valve size and weight can be minimized and a lighter weight non-ferrous valve such as a titanium valve can be used to facilitate oscillation at higher speeds. These advantages working together even make it possible in some embodiments to achieve a thermal efficiency exceeding that of a steam turbine in medium to small sizes, such as those under 1000 horsepower while also being lower in cost. The features and advantages noted above also make the invention well suited for applications such as electric power generation or the co-generation of heat and power, to power a vehicle or for use in solar power generation. A major advantage of the invention over internal combustion engines is its ability to use a variety of low grade fuels including waste or unrefined liquid fuels and low cost biomass without producing harmful nitrogen compounds or other air polluting emissions that are generated by internal combustion engines.

In view of the deficiencies of the prior art it is therefore one object to provide a way of actuating a steam inlet or exhaust valve by piston movement instead of a camshaft while timing at least one steam valve electrically as by means of an electric engine control unit (ECU) without the necessity of forming an inlet valve from a ferromagnetic material.

It is a more specific object to maintain the high thermal efficiency that characterizes the virtual zero or near zero clearance with zero or near zero pressure steam cycle of U.S. Pat. Nos. 8,448,440, 9,316,130, 9,828,886 and Ser. No. 15/794,486 wherein steam admission is controlled electrically through the action of a lightweight steam inlet valve that is able to reciprocate at over 50 cycles per second without the need of a cam shaft or eccentric.

Another object is to operate valves without the use of a camshaft or eccentric while controlling steam inlet valve cutoff timing electrically throughout a wide range as well as providing continuous variable electrical cutoff regulation under changing speeds and loads when needed to achieve a higher overall thermal efficiency than heretofore found in a reciprocating steam engine.

These and other more detailed and specific objects and advantages of the present invention will be better understood by reference to the following figures and detailed description which illustrate by way of example but a few of the various forms of the invention within the scope of the appended claims.

SUMMARY OF THE INVENTION

This invention provides a high efficiency steam engine having a steam inlet and exhaust valves that communicate with a steam expansion chamber located in a cylinder between a piston and cylinder head wherein the exhaust valve can be held open by a spring during the exhaust stroke but is closed proximate an end of the exhaust stroke when there is little or no clearance between the piston and cylinder head. The steam inlet valve is held open by a steam pressure differential across it. During operation the steam inlet valve is closed to cut off steam admission to the cylinder under the control of an ECU or other electric current timer that turns on and off electric current supplied to an electromagnet. In a preferred embodiment, an armature is held in contact with the electromagnet by magnetic attraction so that when the current is turned off at a selected time, a pair of springs propel the armature away from the electromagnet to close the steam inlet valve thereby cutting off the flow of steam to the steam expansion chamber. To remove the pressure differential holding the inlet valve open, a reciprocating cutoff control valve is actuated by movement of the armature to remove the pressure differential thereby causing the steam inlet valve to close at the steam cutoff time selected. In one preferred form of the invention a lifter is supported to reciprocate with the piston in a position which closes the cutoff control valve as the piston approaches top dead center thereby sealing off the steam expansion chamber proximate but prior to an end of the exhaust stroke such that only a small residual quantity of the steam remaining in the steam expansion chamber is compressed by movement of the piston at the termination of the exhaust stroke to a pressure sufficient to open the inlet valve due to the force exerted by the steam thus compressed between the piston and the steam inlet valve.

BRIEF DESCRIPTION OF THE DRAWINGS

FIG. 2 graphs the rate of steam consumption calculated per horsepower hour for the invention at various cutoff settings compared with the corresponding performance of the most efficient high compression reciprocating steam engines previously known.

DETAILED DESCRIPTION OF THE PREFERRED EMBODIMENTS

Figure 1:
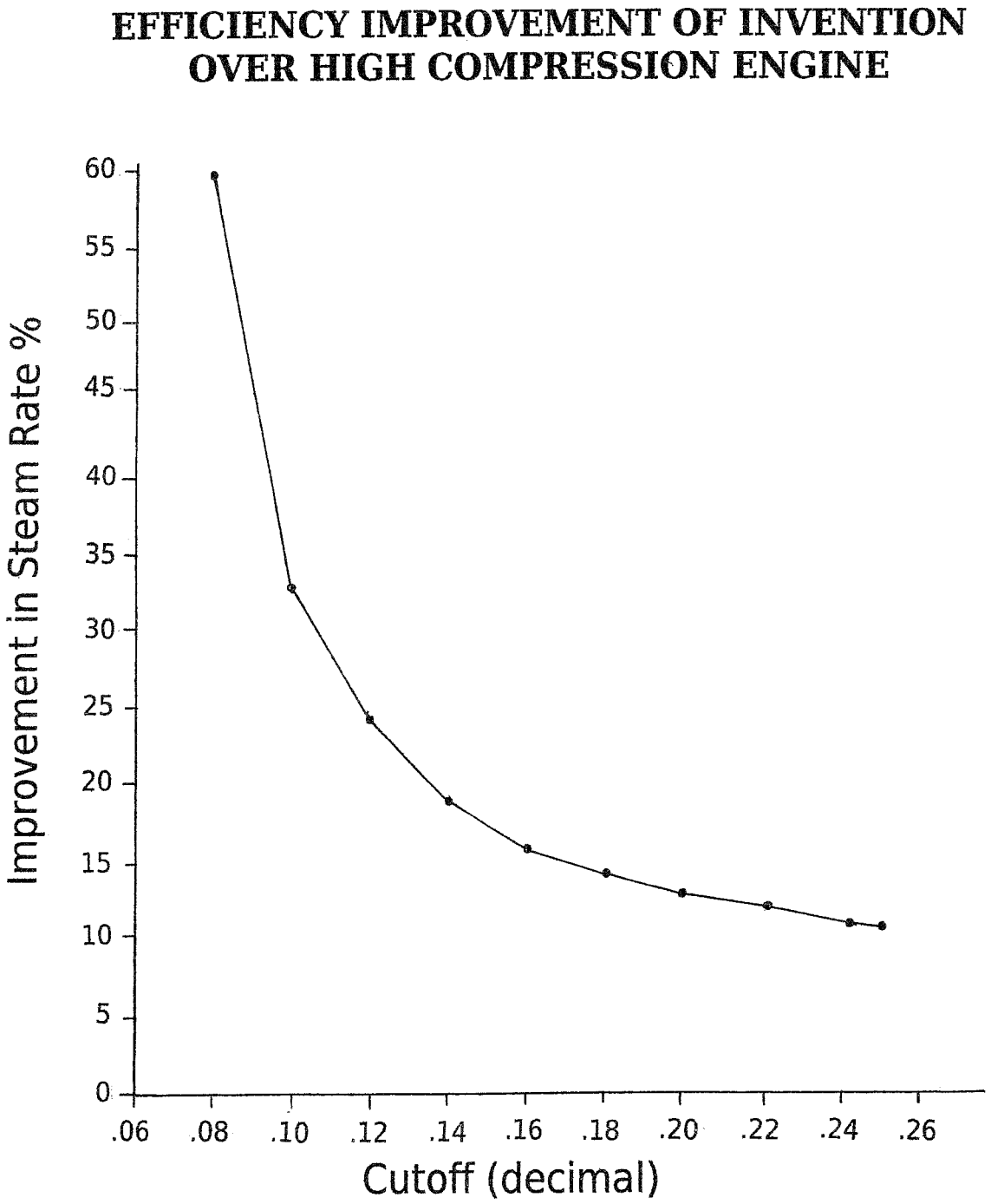
FIG. 1 is a graph showing the improvement in thermal efficiency of the invention computed from the performance graphs of FIG. 2.

Refer now to FIGS. 1 and 2 which show how a very sizeable improvement in thermal efficiency is provided by the present invention compared with what is generally acknowledged to be the most efficient uniflow steam engine design known. FIG. 1 which is derived from FIG. 2 shows that at a 16% cutoff the thermal efficiency of the invention is over 15% better, at 12% cutoff it is almost 25% better and at an 8% cutoff where the prior art is at or near a stall condition there is an extraordinary 59% improvement of thermal efficiency in engines using the present invention. The present invention is about 20% better when each engine is run at its optimum efficiency. In a typical steam engine, the efficiency improves as the cutoff is lowered. FIG. 1 shows that it is the lower cutoff range where the present invention produces its greatest improvement.

FIG. 2 illustrates in the upper graph the performance of a 2 cylinder double expansion high compression steam engine powered by biomass (wood) producing 473 hp to provide 300 KW @an assumed 85% generator efficiency compared to an equivalent engine embodying the present invention with both operating under the same conditions listed in FIG. 2. The term "steam rate" in the Figures refers to the pounds of steam calculated using established thermodynamic relationships to produce a given power output. An inefficient engine of course consumes steam at a higher steam rate than an efficient one. For example in FIG. 2 the high compression compound engine of the prior art (upper graph) at a 10% cutoff consumes 15.6 lbs./hp-hr compared with 12.3 lbs./hp-hr for the invention. The efficiency improvement of the invention (FIG. 1) over the prior art at different cutoff values is computed by comparing the graphs shown in FIG. 2. The thermodynamic formulas used for computing the results shown in FIG. 1 and FIG. 2 are given in Applicant's U.S. Pat. No. 8,448,440, Column 4, line 48 to Column 6, line 21.

It is an advantage to be able to employ an electric control system to operate either ferrous or non-ferrous steam inlet valves. However, due to the delay caused by the magnetic field of an electromagnet to build and collapse, the minimum on and off cycle time that can be achieved by an electromagnet is limited and typically cannot be reduced to much less than 50% of one revolution in an engine running at 5000 RPM. Consequently there is insufficient time for an electromagnet to open and close a steam inlet valve within one revolution when the valve must stay open long enough to admit steam up to as much as 50% of each revolution. To overcome this and other problems, the present invention provides an arrangement of electromagnet, armature and steam inlet valve that enables a steam engine to operate with only a small amount of compression or no compression and a virtual or actual zero clearance running at speeds substantially above 5000 RPM while using electric valve timing to achieve a variable steam cutoff as will now be described with reference to FIGS. 3-5.

Figure 5:
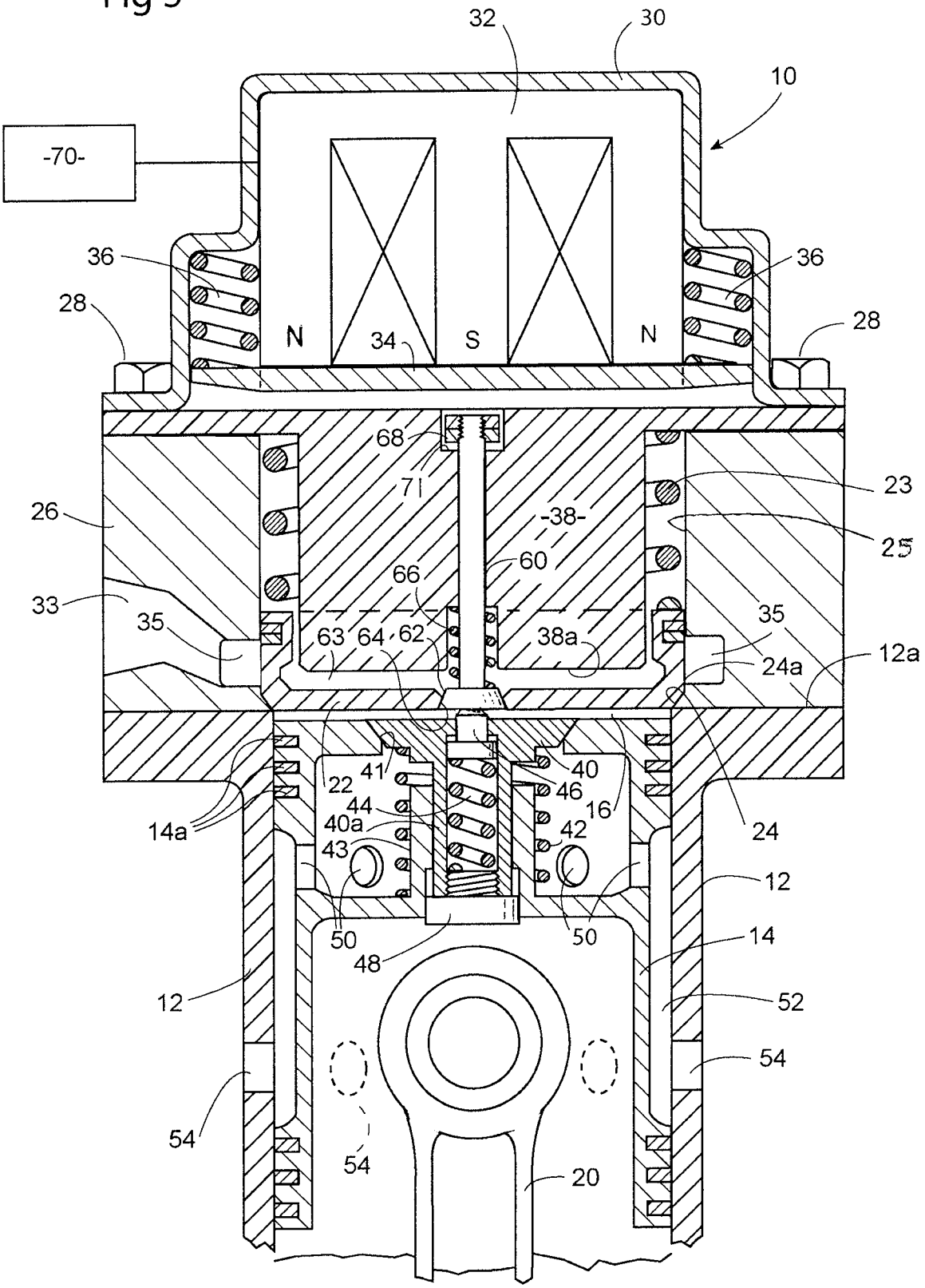
FIG. 5 is a vertical cross sectional view of the upper end of FIG. 3 on a larger scale.

As shown in FIG. 5, the engine indicated generally at 10 has at least one cylinder 12 and a piston 14 that is sealingly and slidably mounted therein at the lower end of a steam expansion chamber 16. The piston has compression rings 14*a* and is operatively connected to a crankshaft 18 (FIG. 3) by means of a connecting rod 20. A cup-shaped steam inlet valve 22 with piston rings as shown is slidably and sealingly mounted in a bore 25 having a counterbore 35 within a cylinder head 26. The horizontal surfaces above and below valve 22 can be textured, e.g., knurled, or have raised areas to enhance propagation of steam pressure waves between mating surfaces. Valve 22 is constructed to normally seal a valve seat 24 in the cylinder head 26 of the engine 10 by being yieldably biased onto the valve seat 24 by a compression spring 23. Spring 23 and the other springs are preferably formed from Inconel or other suitable heat resistant steel alloy.

Valve 22 can be any suitable size but in this embodiment the valve 22 and seat 24 have a slightly larger diameter than that of piston 14 to enable the top of the piston to enter the cylinder head 26 above the top surface 12*a* of the cylinder 12 upon which the cylinder head 26 is mounted and secured in place by bolts 28. These bolts also retain a cover 30 over an electromagnet 32 having poles N and S that attract an armature 34 when the electromagnet 32 is turned on, holding it in contact with the poles during the exhaust stroke and the initial part of the power stroke prior to the cutoff of steam to the cylinder 12. During operation, when the velocity of the piston slows down to zero as it approaches top dead center (TDC) its upper surface is positioned to contact and elevate the inlet valve 22 slightly, e.g., about 0.005-0.030 inch thereby allowing high pressure steam supplied from a steam generator (not shown) or any other steam supply to enter the steam expansion chamber 16 above the piston 14 through a steam supply port 33 and the annular counterbore 35 simultaneously driving the piston downwardly and the inlet valve 22 upwardly in bore 25. Valve 22 is thus moved fully open by means of this steam power assist which is completed in some embodiments in less than 1 ms. The armature 34 is yieldably biased downwardly from the electromagnet by a pair of compression springs 36 held within the cover 30. When the electromagnet is turned off, springs 36 drive the armature onto the upper surface of a valve abutment 38 that has a bottom surface 38*a* which acts as a stop for the steam inlet valve 22 to limit its upward movement in the bore 25 thereby establishing its position when fully open.

Extending through the top of the piston 14 is a supplemental exhaust valve 40 having a hollow valve stem 40*a* that is slidably mounted in a valve guide 43 and biased upwardly off of exhaust valve seat 41 by spring 42. In a chamber within the exhaust valve 40 is a spring 44 that urges a slidable valve lifter 46 to extend through an opening in the upward face of the exhaust valve 40. The spring 44 is held in place by a plug 48 that has an enlarged head at its lower end, the side edge of which limits the lift of the exhaust valve 40 away from its seat 41. When the exhaust valve 40 is opened, steam from the expansion chamber 16 is exhausted past the seat 41 and out of the piston through ports 50 into a space 52 around the piston between seals formed by three compression rings 14*a* shown at each end of the piston and from space 52 out of the cylinder in a first exhaust stage through a ring of exhaust ports 54 that are positioned to communicate with the steam expansion chamber 16 at the end of the power stroke, i.e., at or proximate to bottom dead center (BDC) to allow steam to be exhausted directly from the expansion chamber 16 through exhaust ports 54 at the beginning of the exhaust process. This causes cylinder pressure to drop to ambient or condenser pressure. As a result, steam pressure in expansion chamber 16 which holds the exhaust valve 40 closed during the power stroke is eliminated allowing the exhaust valve 40 to open when the piston is at or close to BDC so that residual steam escapes during the exhaust stroke through exhaust valve 40.

Slidably mounted for reciprocation within a guide bore in the abutment 38 is a cutoff control valve 60 comprising a poppet valve having a valve head 62 which is yieldably biased by a spring 66 downwardly off of a valve seat 64 surrounding a port through inlet valve 22. At the upper end of the valve 60 is an enlarged lug 68 comprising in this embodiment a pair of lock nuts positioned to contact the bottom of a recess 71 for limiting downward movement of the cutoff control valve 60 and hence its lift distance from its seat 64 when inlet valve 22 is closed. During operation, the final upward movement of the piston causes lifter 46 to contact and thereby close the cutoff control valve 60 by lifting it to a closed position on its seat 64 in the closed inlet valve 22 where it is then held by cylinder steam pressure during the first part of the downward power stroke of the piston. By making the exhaust valve spring 42 exert a somewhat weaker force than the lifter spring 44, both valves 40 and 60 will be closed proximate but prior to the end of the exhaust stroke as the inlet valve 22 is opened slightly, e.g., 0.020 inch by piston contact during the terminal upward movement of the piston at the point in the cycle when piston velocity approaches zero and the clearance volume then becomes zero as valve 22 is lifted slightly off its seat thereby filling the nascent steam expansion chamber 16 with high pressure steam so as to hold both of valves 40 and 60 closed from the beginning of the power stroke. Spring 23 of valve 22 is made stronger than either of springs 42 or 44. The valve 22 can be opened either by piston contact as just described or if desired through the compression of a small quantity of residual steam in the cylinder by dimensioning lifter 46 to close valves 40 and 60 during for example the last 0.125 inch upward movement of the piston thereby creating sufficient pressure as the piston approaches to within, e.g., 0.020 inch from the inlet valve to raise the inlet valve by steam pressure alone, i.e., in the absence of physical contact by the piston thereby eliminating shock and tappet-type valve noise. The opening of a steam inlet valve by compressing steam within a recess is disclosed in Applicants' parent application Ser. No. 15/794,486, filed Oct. 26, 2017, now U.S. Patent No. 10,273,840.

The phasing within each cycle of operation when the electromagnet is turned off is set or regulated for example by an electric control unit (ECU) 70 of suitable known construction wired to the electromagnet. In operation, when current is cut off to the electromagnet 32 by the ECU, the springs 36 almost instantly drive the armature 34 downwardly against the lug 68 thereby forcing valve 60 off its seat 64 with the assistance of cutoff spring 66 allowing high pressure steam to enter the cutoff control chamber 63 thereby equalizing steam pressure across inlet valve 22 which enables spring 23 to close the inlet valve 22 at the desired fraction of the power stroke (cutoff point) that is set or regulated by the ECU 70. Tests conducted by the applicant have shown that an inlet valve and spring combination as seen in FIG. 5 can move between an open and closed position in less than 1 ms. at a supply pressure of 125 PSIG which is substantially faster than with cam operation. This helps achieve a significant increase in thermal efficiency compared with customary cam or eccentric operated valves by exposing steam to the piston at full supply pressure earlier in the cycle while also eliminating the cost, complexity and wear of a camshaft, pushrod and rocker mechanism. The armature is raised by the ECU back to the position against poles N and S shown in FIG. 5 during the period between opening valve 60 and the end of the exhaust stroke.

Typically the top of the piston at TDC is positioned to raise the inlet valve 22 about 0.020 inch off of seat 24 or other safe clearance considering thermal expansion from which point it is opened further by steam pressure as described above. The armature can be positioned to lower the valve 60 about 0.10 to 0.20 inches away from seat 64 with additional valve lift provided by spring 66. A vertical rim 24*a* as a part of bore 25 located above the tapered valve seat 24 can have a height of about 0.06 inch to delay the complete opening of the inlet valve 22 enough before TDC to prevent an objectionable kick-back or reverse torque just prior to TDC during operation as described in applicants prior U.S. Pat. No. 8,448,440.

To open the steam inlet valve 22 silently with little expenditure of power, the lifter 46 is dimensioned to extend out of the exhaust valve 40 only a small fraction, e.g., ⅛ of an inch. Since lifter spring 44 is stronger than exhaust and timing springs 42 and 66, near the end of the exhaust stroke both valves 40 and 60 will be closed by lifter 46 about ⅛ inch before the piston reaches TDC thereby facilitating compression of a small volume of residual steam proximate TDC down from ⅛ inch to, for example, a 0.020 inch clearance. If the net upward force of the compressed steam is 25 lbs. over a compression distance of ⅛ inch, at 1000 RPM the horsepower required to open the steam inlet valve against the downward spring force of 25 lbs. is a negligible 0.008 horsepower at 1000 RPM. By compressing only a small volume of residual steam during the terminal part of the exhaust stroke proximate TDC in accordance with the present invention, the compression loss characterizing the prior art such as that illustrated in the upper curve of FIG. 2 is avoided. Pressure developed in a clearance volume having a diameter of 3 inches, when it reaches 3.6 PSIG will overcome a net spring biasing, i.e., closing force of 25 lbs. on valve 22 thereby slightly opening valve 22 solely by the force of the compressed steam and the rest of the way by steam at supply pressure entering from counterbore 35. By preventing physical contact between the piston 14 and valve 22 in this way, any valve shock, tappet noise or valve wear that would otherwise occur is eliminated.

Figure 3:
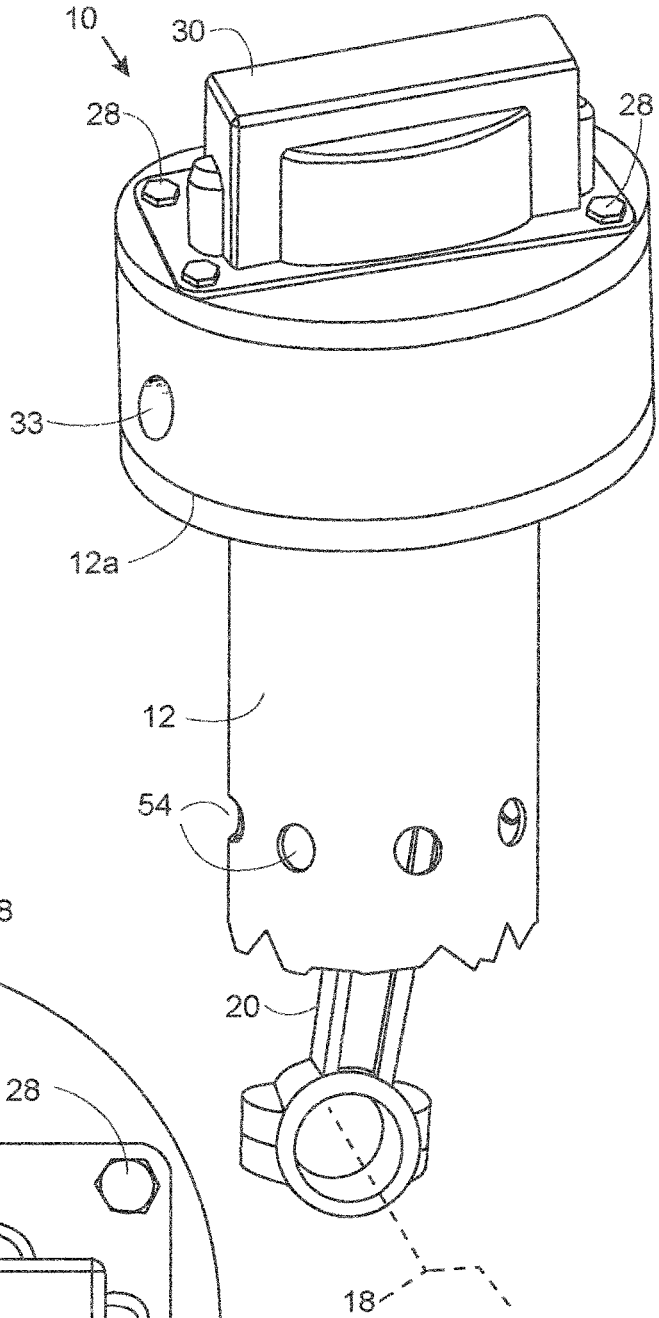
FIG. 3 is a perspective view of one engine cylinder embodying the invention.
Figure 4:
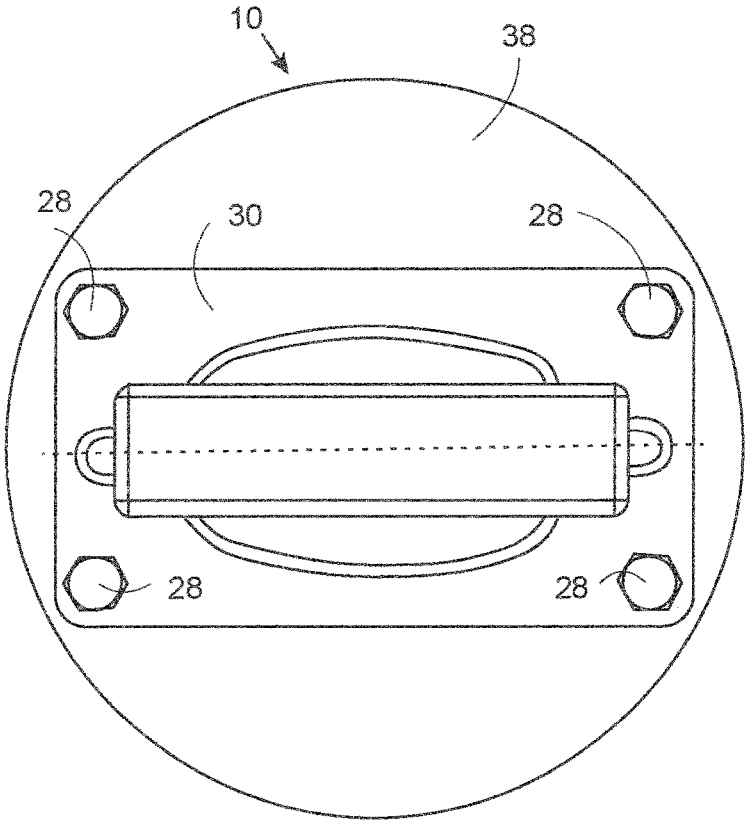
FIG. 4 is a top view of FIG. 3 on a larger scale.

A summary of the operation of FIGS. 3-5 is as follows. The upward motion of the piston approaching TDC lifts both valves 22 and 60 opening steam inlet valve 22 slightly after which it is raised further, e.g., about 0.12 inch almost instantly to a fully open position by means of a steam pressure assist provided by steam entering the clearance volume of the steam expansion chamber 16 to produce a lifting force on valve 22 far in excess of the force of spring 23. At the time selected for cutoff, the downward movement of the armature 34 provided by springs 36 as the electromagnet 32 is turned off by the ECU 70 forces the valve 60 open by contacting the lug 68 thereby equalizing pressure across valve 22. This pressure equalization enables spring 23 to close the steam inlet valve 22 at the time selected for cutting off the steam supplied to the cylinder. When the piston 14 reaches BDC, exhaust of steam through exhaust ports 54 lowers pressure in the expansion chamber 16 enabling the spring 42 to open the supplemental exhaust valve 40. Spring 66 is also able to hold valve 60 open lowering the pressure in control chamber 63 to prepare for the next cycle. At the end of the exhaust stroke as the piston approaches TDC, the lifter 46 contacts the valve 60 closing both valve 60 and valve 40 prior to the opening of the inlet valve 22 at the beginning of the next cycle so as to provide the steam pressure needed in the clearance volume to hold valves 40 and 60 closed during the power stroke.

Figure 6:
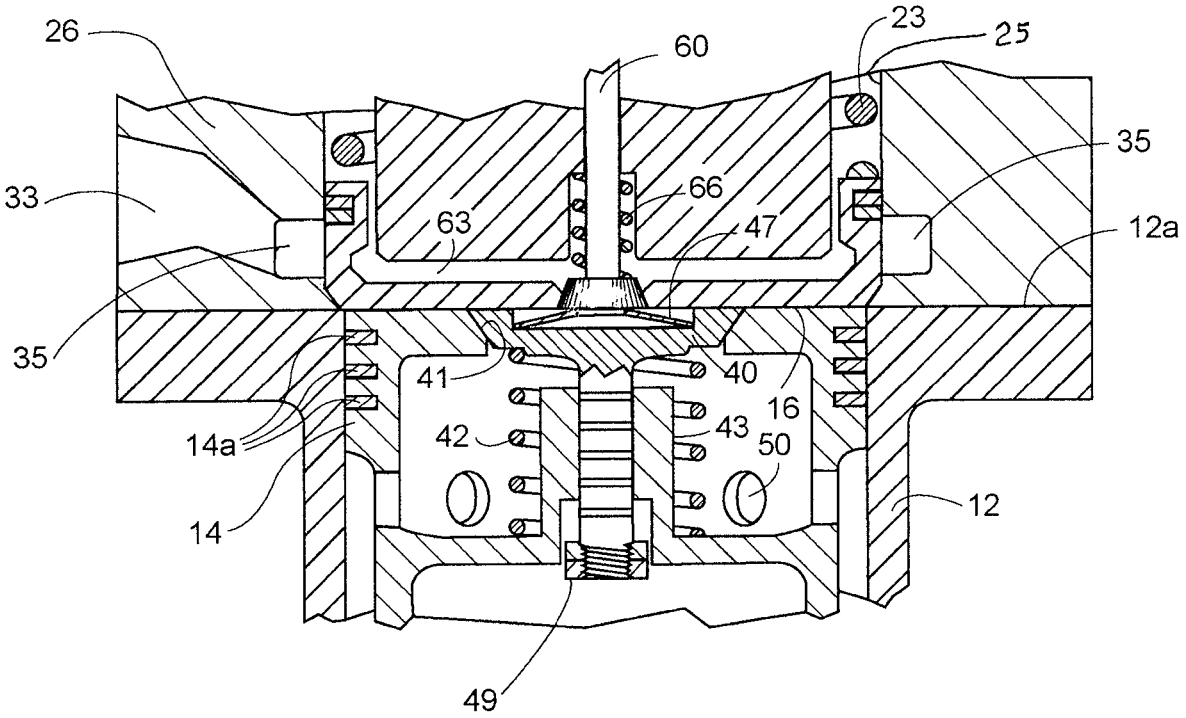
FIG. 6 is a partial vertical sectional view similar to FIG. 5 with a different cutoff control valve closing spring.

Refer now to FIG. 6 wherein the sliding valve lifter 46 and its spring 44 shown in FIG. 5 are replaced by a disc or Belleville spring 47 that is held in a recess within the top of exhaust valve 40 so that its smaller end faces upwardly in position to contact and close valve 60 proximate TDC. A lug 49 such as a pair of locknuts limit the lift of the exhaust valve 40.

Figure 7:
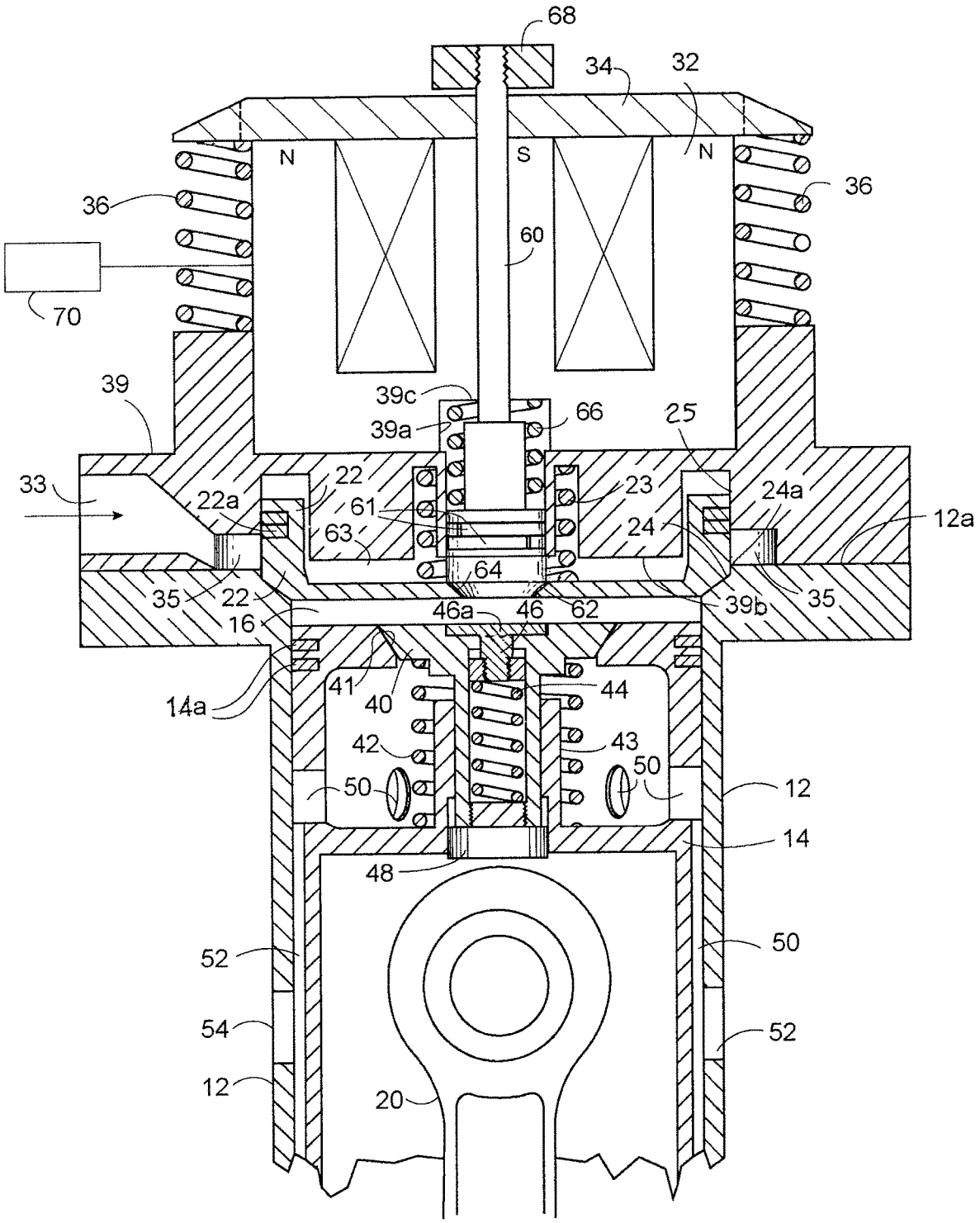
FIG. 7 is a view similar to FIG. 5 of another embodiment of the invention.

Refer now to FIG. 7 which illustrates another embodiment of the invention wherein the same numerals refer to corresponding parts in the previous views, FIG. 7 is similar to FIG. 5 in most respects, however in FIG. 7, the electromagnet 32 is inverted so that the poles are at the top and the armature 34 which is positioned above the electromagnet is biased upwardly by the springs 36 rather than downwardly as in FIG. 5. The stem of cutoff control valve 60 extends slideably through both the electromagnet and the armature 34 with the lug 68 affixed to its upper end spaced slightly from the armature. When the electromagnet is on, the armature is held in contact with poles N and S and the springs 36 are under compression. When the ECU turns off the electromagnet, the springs 36 drive the lug 68 and valve 60 upwardly at the time selected for cutting off the flow of steam to the cylinder as will be described. Valve 60 has a cylindrical head at its lower end which is encircled by a pair of compression rings 61 that forming a seal with the surrounding bore. Valve 60 has a tapered valve sealing surface 62 at its lower end which seals a tapered valve seat 64 surrounding a port through the steam inlet valve 22. Valve 60 is biased downwardly by the spring 66 which is held under compression in compartment 39*a*. The cylinder head 26 and the abutment 38 of FIG. 5 have been combined as a single piece in FIG. 7 to form a cylinder head 39 having an abutment surface 39*b* which can limit upward movement of valve 22 as in FIG. 5. Below the cylindrical portion of valve 60 holding the compression rings 61 the annular sealing surface 62 tapers inwardly toward its lower end enabling valve 60 to open when moved upwardly rather than downwardly as in FIG. 5. The lifter 46 mounted in the upper face of the exhaust valve 40 of FIG. 7 has a flat plate portion 46*a* at its upper end of sufficient diameter to engage valve 22 when approaching TDC causing exhaust valve 40 to close slightly before TDC.

Just prior to the time selected for cutoff as the ECU interrupts current to the electromagnet 32, springs 36 raise valve 60 off of its seat 64 equalizing the pressure between the cutoff control chamber 63 and the expansion chamber 16 enabling steam inlet valve 22 to be closed at the desired cutoff by spring 23. Valve 60 will rise until a shoulder on the stem of valve 60 contacts the upper end 39*c* of the compartment 39*a*. At the end of the exhaust stroke when valve 22 is elevated slightly, e.g., 0.020 inch either by providing for physical contact with it by piston 14 as the piston slows to zero velocity at TDC or by compressing a small volume of residual steam in the steam expansion chamber 16. Valve 22 is then opened fully by the steam assist force provided by steam entering the cylinder as described herein above causing valve 22 to seat itself on the face 62 of valve 60 and optionally also on the lower surface 39*b* of the cylinder head 39 as steam enters the cylinder at the beginning of the power stroke. The springs 36 hold valve 60 open during the first part of the exhaust stroke to lower pressure in chamber 63 to ambient prior to the moment ECU turns on the electromagnet 32 which then closes valve 60 while the pressure in chamber 63 is low to prepare for the next cycle. Other aspects of the form of the invention shown in FIG. 7 are as already described in connection with FIG. 5.

Another embodiment of the invention (not shown) is the same as FIG. 7 except that the electromagnet 32, the armature 34 and springs 36 are all inverted together as a unit so that when the electromagnet is turned on during the power stroke, the control valve 60 which does not pass through the electromagnet is pulled upwardly by the armature 34 against the biasing force of springs 36 lifting the head of cutoff valve off its seat 64 enabling steam to enter chamber 63 thereby equalizing steam pressure across the steam inlet valve 22 which is then closed by spring 23 so as to cut off the flow of steam to the expansion chamber 16.

The invention makes it possible to use an electrical signal to almost instantly close either a ferrous or non-ferrous inlet valve 22 (FIGS. 5-7) that is opened by piston motion. Once valve 60 is opened, a substantial time interval is available for reseating the armature 34 into contact with electromagnet 32 before the cycle repeats thereby enabling the engine to run at higher RPMs, e.g., in excess of 5000 RPM in spite of the delay due to the time required for the magnetic flux field to build and collapse.

Many other variations within the scope of the appended claims will be apparent to those skilled in the art once the principles disclosed herein are read and understood.

What is claimed is:

1. A steam engine comprising;

at least one cylinder having a piston that is sealingly and slidably mounted therein at an end of a steam expansion chamber and is operatively connected to a crankshaft;

the engine having a steam supply port;

a steam inlet valve that is constructed to seal a valve seat in the steam engine that communicates between the steam supply port and the steam expansion chamber;

a steam exhaust valve communicating with the steam expansion chamber;

an electric control unit connected to an electromagnet constructed for holding an armature proximate thereto when electric current is supplied thereto, the armature being operatively associated with the steam inlet valve; and a cutoff valve that is mounted in the steam engine for reciprocation and is responsive to actuation by movement of the armature of the electromagnet to close the steam inlet valve for the cutting off an admission of steam to the expansion chamber.

2. The steam engine of claim 1, wherein at least one spring is connected to the armature in a position for driving the armature away from the electromagnet when the current to the electromagnet is turned off by the electric control unit such that the armature is then propelled by the at least one spring away from the electromagnet causing the steam inlet valve to close for cutting off the supply of steam to the steam expansion chamber at a selected time responsive to a termination of the electric current supplied to the electromagnet.

3. The steam engine of claim 1, wherein the steam engine includes a cutoff timing chamber on an opposite axially spaced end of the inlet valve from the steam expansion chamber;

wherein the cutoff valve is positioned to seal communication between the cutoff timing chamber and the steam expansion chamber; and wherein the armature is constructed and arranged to open the cutoff valve when the armature is actuated by the electromagnet to move from a first position to a second position such that steam then flows from the expansion chamber to the cutoff timing chamber whereupon the steam inlet valve closes thereby cutting off a supply of steam to the steam expansion chamber at a selected time responsive to operation of the electromagnet.

4. A steam engine comprising;

at least one cylinder having a piston that is sealingly and slidably mounted therein at one end of a steam expansion chamber and is operatively connected to a crankshaft;

the engine having a steam supply port;

a steam inlet valve mounted in the engine that is constructed when in a closed position to seal a valve seat in the engine that communicates between the steam supply port and the steam expansion chamber;

a steam exhaust valve mounted for reciprocation in the engine in communication with the steam expansion chamber for exhausting steam therefrom;

a spring supported by the steam exhaust valve in a position to operate a cutoff control valve in the engine that communicates with the steam expansion chamber, said cutoff control valve being moved by the spring when the piston approaches a top dead center position thereby closing the cutoff control valve; and an electric control unit operatively connected to control an operation of at least one valve.

5. The steam engine of claim 4, wherein the spring is mounted upon the exhaust valve and the exhaust valve is closed by a force applied thereto by the spring.

6. The steam engine of claim 4, wherein the cutoff control valve seals an opening between the steam expansion chamber and a cutoff timing chamber located at an end of the steam inlet valve that is spaced axially from the steam expansion chamber.

7. A steam engine comprising;

at least one cylinder having a piston that is sealingly and slidably mounted therein at one end of a steam expansion chamber and is operatively connected to a crankshaft;

the engine having a steam supply port;

a steam inlet valve that is constructed to seal a valve seat in the engine that communicates between the steam supply port and the steam expansion chamber;

a steam exhaust valve communicating with the steam expansion chamber;

a cutoff control valve mounted for movement in the engine that is constructed and arranged to seal an outlet to the steam expansion chamber;

a lifter supported to reciprocate with the piston in a position to close the cutoff control valve as the piston approaches top dead center thereby sealing the steam expansion chamber proximate but prior to an end of an exhaust stroke such that a residual quantity of steam remaining in the steam expansion chamber is compressed by movement of the piston proximate the end of the exhaust stroke to a pressure that opens the inlet valve in response to a force applied to the inlet valve by the steam thus compressed; and an electric control unit connected to the electromagnet.

8. The steam engine of claim 7, wherein the lifter is mounted on an exhaust valve that is supported by the piston at an end of the piston confronting the steam expansion chamber.

9. The steam engine of claim 7, wherein the lifter is spring mounted on an exhaust valve supported on the piston.

10. A steam engine comprising;

at least one cylinder having a piston that is sealingly and slidably mounted therein at one end of a steam expansion chamber and is operatively connected to a crankshaft;

the engine having a steam supply port;

a steam inlet valve that is constructed to seal a valve seat in the engine that communicates between the steam supply port and the steam expansion chamber;

a steam exhaust valve communicating with the steam expansion chamber;

a cutoff control valve that is slidably mounted for reciprocation and is positioned to seal communication between the steam expansion chamber and a cutoff control chamber located in the engine that is in communication with the cutoff control valve and the steam inlet valve;

an electromagnet having an armature operatively associated to allow the cutoff control valve to move at a selected time in a cycle of engine operation for admitting steam into the cutoff control chamber to enable the inlet valve to close thereby cutting off the flow of steam to the steam expansion chamber; and an electric control unit connected to the electromagnet.

11. The steam engine of claim 10, wherein, the engine is constructed and arranged to enable steam to be exhausted from the expansion chamber during a part of each exhaust stroke and the expansion chamber then being sealed during the exhaust stroke when the piston is proximate but prior to a top dead center position to thereby limit a portion of the stroke during which steam compression occurs within the expansion chamber while enabling sufficient steam pressure to be produced during a terminal fraction of the exhaust stroke approaching zero clearance such that the steam thus compressed is able to open the inlet valve at least slightly; and wherein an opening of the inlet valve then permits steam from the steam supply port to enter the steam expansion chamber and to apply an additional opening force against an end of the inlet valve to propel the inlet valve to a more fully open position.

12. The steam engine of claim 11, wherein piston clearance provided in the expansion chamber at top dead center is either zero or a narrow gap of 0.125 inch or less and a length of the terminal fraction of the exhaust stroke during which compression occurs is less than 0.25 inch.

13. The steam engine of claim 11, wherein the cylinder has a side wall with one or more exhaust valve ports that communicate with the expansion chamber when the piston reaches a bottom dead center position.

14. The steam engine of claim 11 that is adapted to facilitate a zero piston clearance and a zero cylinder volume, wherein the piston has a first diameter and the inlet valve has a second diameter located proximate the first diameter of the piston at top dead center which is larger than the first diameter of the piston whereby as piston velocity reaches zero at top dead center the piston is thereby unable to come into contact with a cylinder head.

* * * * *